US008100225B2

(12) United States Patent
Bartha et al.

(10) Patent No.: US 8,100,225 B2
(45) Date of Patent: Jan. 24, 2012

(54) ROOM DAMPENING PANEL

(75) Inventors: Andrew Bartha, Gaston, OR (US); Andrew E Flanders, Cornelius, OR (US)

(73) Assignee: Nucore Technologies Inc., Hillsboro, OR (US)

( * ) Notice: Subject to any disclaimer, the term of this patent is extended or adjusted under 35 U.S.C. 154(b) by 0 days.

(21) Appl. No.: 11/900,803

(22) Filed: Sep. 13, 2007

(65) Prior Publication Data

US 2008/0069388 A1 Mar. 20, 2008

Related U.S. Application Data

(60) Provisional application No. 60/844,580, filed on Sep. 13, 2006.

(51) Int. Cl.
*E04B 1/82* (2006.01)

(52) U.S. Cl. ..... 181/290; 181/30

(58) Field of Classification Search ..... 181/30, 181/290, 293

See application file for complete search history.

(56) References Cited

U.S. PATENT DOCUMENTS

| | | | | | |
|---|---|---|---|---|---|
| 2,000,806 | A * | 5/1935 | White | 181/30 |
| 2,132,642 | A * | 10/1938 | Parsons | 428/137 |
| 2,159,488 | A * | 5/1939 | Parkinson | 52/145 |
| 2,502,016 | A * | 3/1950 | Olson | 181/295 |
| 2,656,004 | A * | 10/1953 | Olson | 181/295 |
| 2,966,954 | A * | 1/1961 | Sabine | 181/289 |
| 3,460,299 | A * | 8/1969 | Wilson | 52/144 |
| 4,787,296 | A * | 11/1988 | Huang | 454/212 |
| 5,780,785 | A * | 7/1998 | Eckel | 181/295 |
| 6,601,673 | B2 * | 8/2003 | Murakami et al. | 181/293 |
| 6,817,442 | B2 * | 11/2004 | Van Sleet et al. | 181/293 |

* cited by examiner

*Primary Examiner* — Jeremy Luks

(57) ABSTRACT

An acoustic treatment room dampening panel 10 is arranged to support at least three layers of material 3 with multiple through holes 2. Each layer of material with through holes are spaced apart, with through holes off set between layers, such that air flow is restricted and turbulence created, thus dissipating standing wave energy. The panels are intended for flush mounting against walls or ceiling at the apex of a room to help dissipate standing wave energy which stands up in the corners of a room.

18 Claims, 13 Drawing Sheets

ROOM DAMPENING PANEL

CROSS REFERENCE TO RELATED APPLICATIONS

This application claims the benefit of priority under 35 USC 119(e) of U.S. provisional patent application No. 60/844,580, which was filed on Sep. 13, 2006, the entire disclosure of which is incorporated herein by reference.

BACKGROUND OF THE INVENTION

1. Field of the Invention

The present invention relates to the manufacture and use of audio energy absorbing Room Dampening Panels (RDP's) for the reduction of harmonic phase distortions and for the control of room resonance, frequency responses and sound level rises in order to clarify and improve the intelligibility of speech and musical performances in the reproduction of sound.

2. Background Art

While many acoustic treatment devices can effect midrange and high frequencies, very few acoustic room treatment products are effective at controlling frequencies below 200 Hz. This is primarily due to the long wavelength of the sound waves at the low frequencies. Products designed to address frequencies below 200 Hz are all very large and as a result both expensive, and difficult to place in a room. (Both Echobusters and ASC make floor standing bass traps that work on deep bass, but these are all at least 5 feet tall, expensive to purchase and ship and obtrusive in situ).

3. Technical Discussion of Room Response to Frequencies

Room response to various frequencies of the sound spectrum is usually described in terms of reverberation or "boomy" echo. Most state of the art acoustic room treatment materials and devices affect the higher frequencies well above middle-C, 261 Hz≈250 Hz, whereas mid and low frequency response reflects the room size, geometry and presence of large objects. The mid-low frequency response often is difficult to correct in order to obtain the desired intelligibility of speech and good definition of musical performance.

The wavelength of mid-low frequencies or multiples thereof may fit well into the major dimensions of the room as determined from $\lambda=c/f$ causing a build-up or boom.

$\lambda$: wavelength in feet.

c: speed of sound at 1087 feet/sec f: frequency in Hz or cycles/sec.

Since the pitch of a tone was established centuries ago for the pipe organ in terms of the half-wavelength of an open pipe in feet, it is convenient and meaningful to describe frequency in terms of half-wavelength. The basic formants of the human voice, it will be noted, are near multiples of 8 foot combinations of many room dimensions. Therefore, the room may not only color the human voice but also interfere with articulation by room resonance "hang over".

Female: just below middle-C @ 2 feet

Male: just below tenor-C @ 4 feet

Standard pitch: bass-C (65 Hz @ 8 feet.

Some natural dampening of the room resonance, though not optimum, may be realized by reflections from architectural offsets, large furnishings, padded carpeting and large windows that are compliant to low frequency. Corner reflections may provide very long half-wavelength responses with harmonics near voice or instrumental formants to give artificial or smeared enunciation and blurred musical reproduction.

As acoustic waves "fill" a room, they stand up in a cosine fashion with wave peaks at the walls and corners, being most intense where corners meet ceilings and floors. Since the ear is not polarity sensing, either a "+" portion of a wave or a "−" portion may fit between walls or corners to give a good fit as half-wavelengths of a frequency. Half-wavelengths as multiples of a room dimension wall-to-wall or corner-to corner may exhibit considerable Q with noticeable confusion and blurring at much higher frequencies even though the response rise is a multiple of some room dimension for a long wavelength (low frequency).

Everyone has been in good sounding rooms; where it is comfortable to converse, or a music room or concert hall or theater where performances just sound better, more balanced, you can understand the lyrics, etc. Conversely, we have all been in restaurants where you can't hear someone speaking across the table, or the concert hall where you can't enjoy the performance because of sonic congestion, or the music room where your ears are overwhelmed with "boomy" bass, or disappointed by lack of bass.

Fundamentally all rooms will acoustically "load" to a certain extent. By this we mean that the large flat surfaces—the walls and ceiling—gather energy, and where they meet, especially at the corners near the ceiling, where there are no furnishings to disrupt the energy flows, acoustic energy will build up and horn load back out into the room. This effect will be greater or lesser in room depending on the overall size and the mathematical relationship between the dimensions of length, width and ceiling height. The theory (well proven in practice) is that if you can "equalize" acoustic pressure in the corners, significant improvements to smoothing out room response result. In a better equalized room, like that better sounding concert hall, everything sounds better.

The first successful product to address this upper corner effect was the "Corner-Tune", a triangular pillow from Room Tune, with a reflective side and an absorbing side. At the time, it was called by many to be the single most important thing to improve the listening experience in a room. An untreated room can seriously compromise even the best components.

Although early investigations in musical science during the $19^{th}$ century established that the phase of tone harmonics was insignificant, with the advent of advanced instrumentation during the $20^{th}$ century along with electronic music, investigations by a few brought this premise into question. A Master Thesis of May 1968, "A Compendium on Research into the Aural Perception of Harmonic Phasing", by Andrew E. Flanders concluded that phase of harmonics is perceived. Dr. Karlheinz Stockhousen further verified this in the midst of his research in a demonstration at the Cow Palace in Burlingame, Calif. in which the speakers had to be properly phased to obtain the results he heard in Germany. A few other papers were shortly published observing that waveform is distinguished by the ear. Therefore, the phase of harmonics becomes a consideration.

The question then remains, what determines the phase of harmonics in the synthesis of sound or in the reproduction of speech and music? The answer is found in a fundamental premise of System Engineering, the Bode Criteria or Theorem:

> The phase angle of a network at any desired frequency is dependent on the rate of change of gain with frequency, where the rate of change of gain at the desired frequency has the major influence on the value of the phase angle at that frequency.

The "rate of change of gain" of a network is another way of describing the response slope in dB/octave within a network or the rise and fall of sound energy (SPL) over its spectrum in dB/octave. A rise in sound level over a range of frequencies within the room results from resonance with a corresponding phase change of harmonics and degradation in intelligibility and definition.

The rise in sound level from resonance is frequently observed to be reduced when occupants absorb sound energy from a normally very live room. In addition, doors or windows open to the outside or into adjacent space exhaust sound energy to reduce the resonant rise. If these space opening are located in the mid region of the sides of the room, the reduction in resonant rise may hardly be noticed since the peak area of the standing waves is elsewhere, usually in corners.

The architectural construction of space openings in rooms, meeting halls, theaters and stadiums to reduce resonant rise and best facilitate the reproduction of vocal, musical and other sounds is, if even possible, an expensive, awkward and often unaesthetic solution to the various problems associated with the reproduction of sound. What is required is an inexpensive and effective room Dampening solution such as that provided by the current invention, the Room Dampening Panel (RDP) which may be placed in corners near the ceiling and or the floor with noticeable results in improved intelligibility and articulation as that is where the maxim SPL of standing half-waves occurs.

4. Description of the Invention

From the above explanation and relationships a useful size emerges for RDP home use. Since the higher frequencies of concern include the tenor octave starting at middle-C near the female formant fundamental at about the 2' half-wavelength, a major dimension of the RDP should encompass a large portion of the crest time base. Therefore, a 15" length or ⅝ths of 2' was selected as being compatible with typical residential front room listening areas. A well-proportioned width of 10" provides a panel much like that of many pictures in décor.

The panel consists of 3 layers of ⅛" pegboard with ¼" diameter holes on 1" centers. The pegboards are spaced about 5/16" apart by grooves in the 1" wide by 2" deep edges of the panel picture frame that holds the pegboard layers together. The spacing of the holes in the front and back pegboards is aligned to each other. However, the middle pegboard uniquely provides its holes in rows and diagonals that are staggered in their positional relationships to the holes in the front and back outer pegboard layers. It is this staggered arrangement that is largely responsible for the desired Dampening action. In addition, ⅛"×½"×9" felt strips are bonded midway between alternate rows of the middle pegboard on one side and the next alternate rows of the other side. This leaves a small clearance between the felt strips surface and the outer pegboards. (See a partial cutaway sectional view in FIG. 1.)

As a sound wave is positioned in a corner with cosine peak at maximum SPL for a brief moment, acoustic flow progresses through the outer holes and immediately diffracts to fill the inner space as it expands in a turbulent manner absorbing energy to arrive at a lower SPL over its entire volume and area. This repeats going through the inner layer and again as it goes through the back layer. As the sound waves reverse to the opposite polarity, e.g. "−", the acoustic flow also reverses as if by suction absorbing energy as before and continues for each half-wave.

In addition, as sound pressure develops between the inner and outer boards this "pressure" "+" or "−" is partially absorbed by the intervening felt strips. The combined result in effect exhausts acoustic energy from the room at low frequencies similar to a real hole in the wall, but where the location of such a hole would be unacceptable in the best absorption locations and inconveniently costly. In effect, a "portable hole in the wall" has been achieved with its primary absorption at mid and low frequencies. The between holes spacing of one inch for each half-wave of higher frequencies translates into 2 inches wavelength yielding a good reflection at and above 6 kHz maintaining much of the articulation spectrum.

One may conclude from the above that proper Dampening of a room's natural resonance with only a few dB/octave rise reduces harmonic phase distortion resulting in improved intelligibility, enunciation and definition. The size and number of RDP's, perhaps in pairs, may be selected to provide adequate Dampening over the spectral region of concern. The location is vital to RDP performance and is usually best near the corner ceiling and or being spaced about ½ of the half-wavelength of the high frequency of interest or a bit less to please the eye, e.g. about 1 foot in this example of a prototype.

5. Brief Description of the Drawings

FIGS. 4,5,6,7,8, provide graphical illustrations of Dampening effectiveness when examining different panel parameters.

Figure 9:
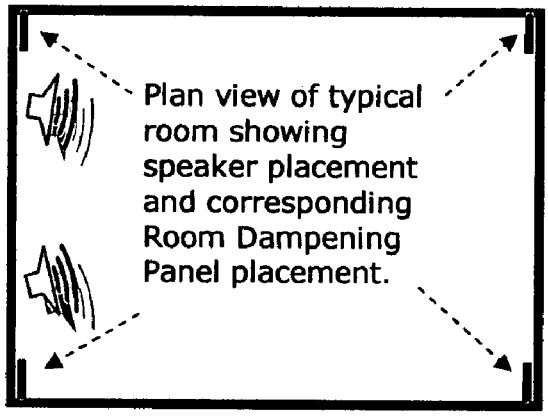
Figure 10:
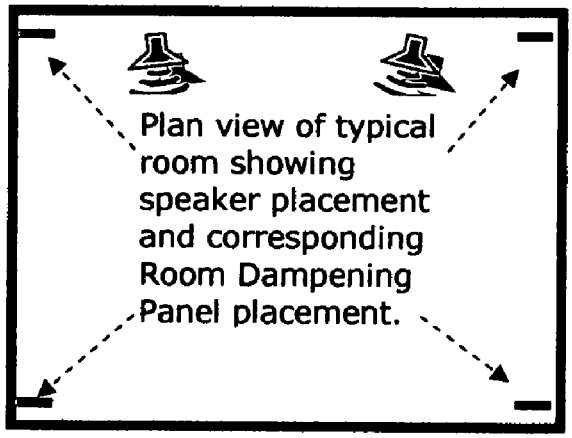

FIGS. 9,10 illustrate how the panels should be positioned for maximum effect. If Speakers are positioned on the "Short Wall" (FIG. 9), ideal positioning for the Room Dampening Panels is on the "Short Walls" near the apex (corner) of room 6~8 inches from the ceiling, and 1~2 inches away from the adjoining wall. If ideal positioning is not feasible, Room Dampening Panels may alternatively be placed on the "Short Walls" in corners of room at floor level.

If Speakers are positioned on the "Long Wall" (FIG. 10), ideal positioning for the Room Dampening Panels is also on the "Long Walls" near the apex (corner) of room with the same spacing as above. Room Dampening Panels may alternatively be placed at floor level. Spacing from adjacent walls may be increased, ideally not to exceed 6 inches. Panels may be located on the adjacent walls if desired.

Panels may be mounted vertically or horizontally to suit aesthetic preference. Panels should be flush with the wall surface with no one edge more than 1/16" away from the wall.

Figure 11:
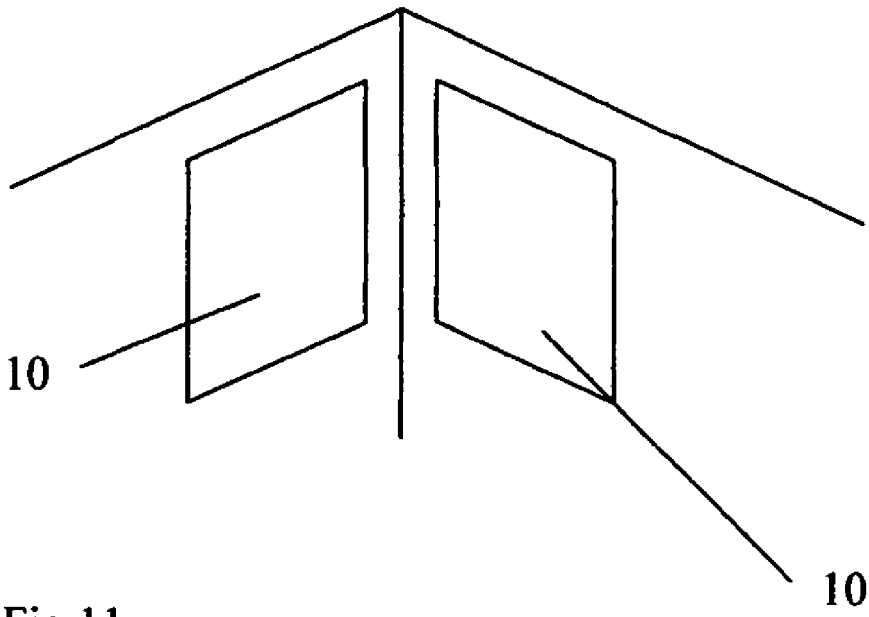

FIG. 11 illustrates how two panels may be located in the apex (corner) of a room to increase dampening effect.

Figure 12:
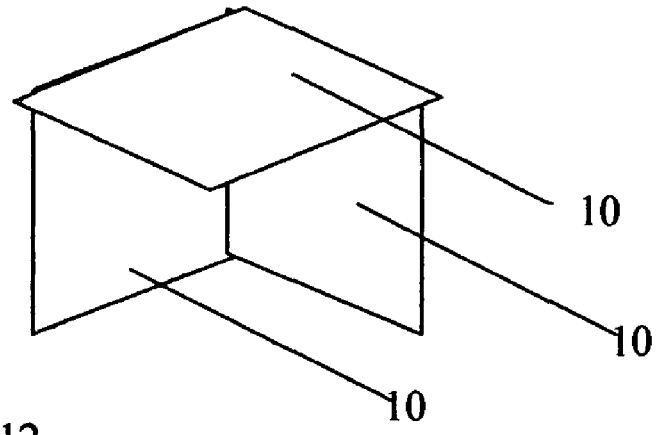
Figure 13:
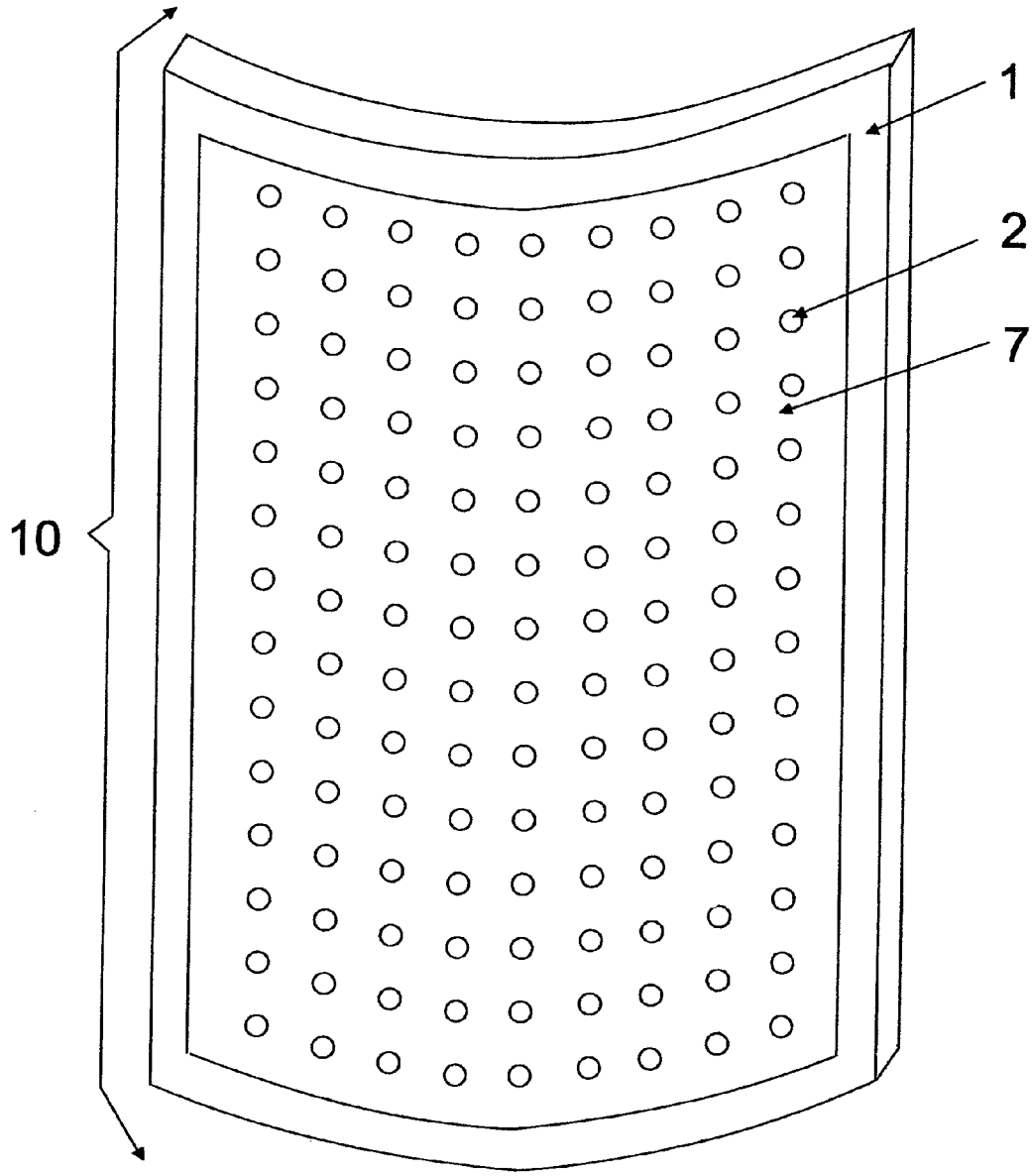

FIG. 12 illustrates how three panels may be combined on 3 adjoining faces of a corner, each wall and ceiling and or floor, to further increase dampening effect FIG. 13 illustrates how three panels, not necessarily identical in individual form, may be joined together to form 3 adjoining faces to further increase dampening effect and fit snugly into the apex corner of a room where the walls meet the ceiling in an aesthetically pleasing manner.

6. Detailed Description of the Preferred Embodiment

Figure 1:
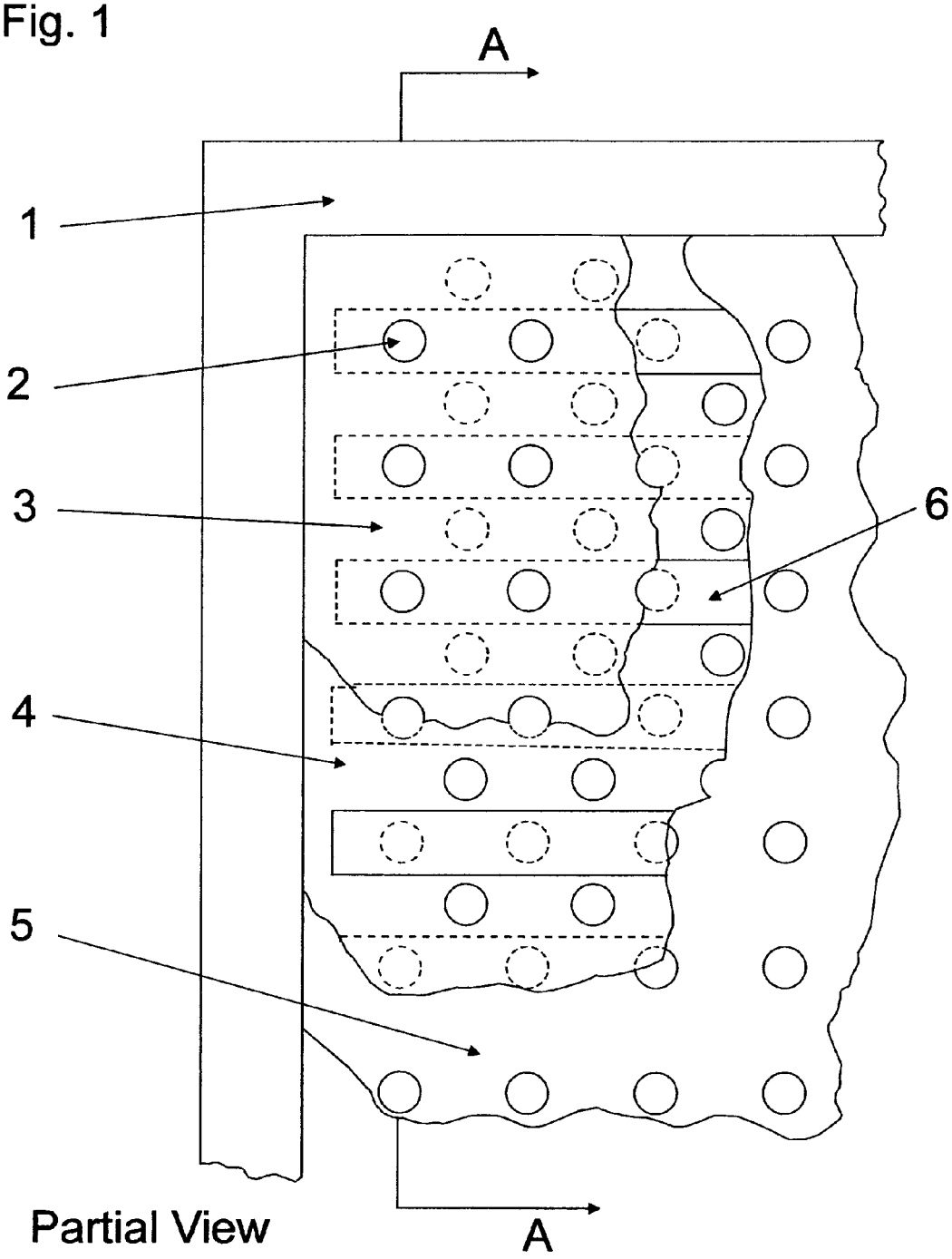
FIG. 1 shows a partial cutaway sectional view of the panel construction
Figure 3:
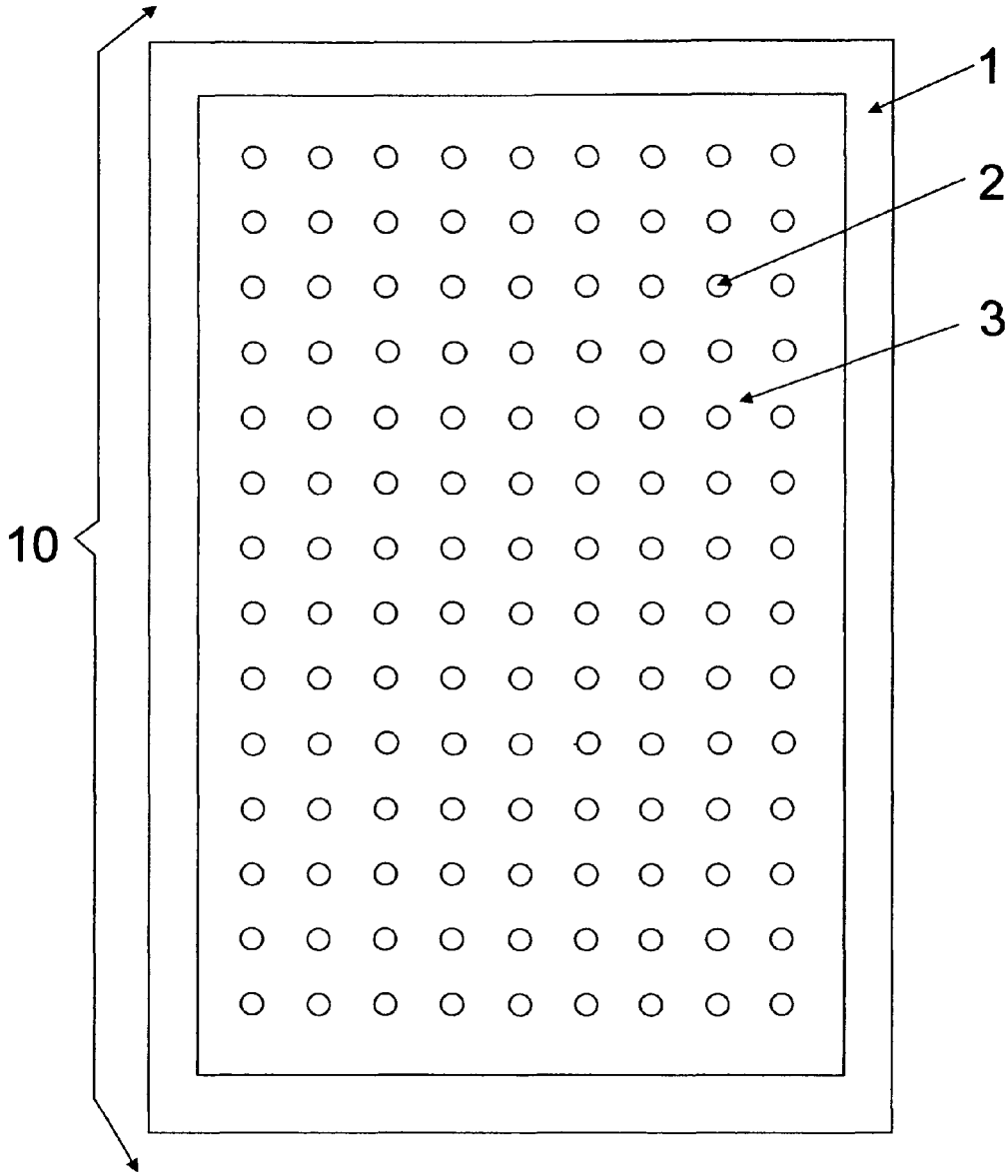
FIG. 3 shows a simplified front view of the panel

Referring now to the drawings, FIG. 1 shows a partial cut out front view of the product 10, as given in FIG. 3. A frame 1 supports the three layers of pegboard. Front layer 3, with multiple through holes 2 of an appropriate diameter and spacing to induce turbulence and thereby dissipate sound pressure as heat, middle layer 4, spaced apart from the front layer 3 with through holes 2 off-set from through holes 2 of front layer 3 forming a cavity holding (briefly) the sound at reduced SPL as it continues through the back layer 5, again with through holes 2 off-set from the through holes 2 of middle layer 4, dissipating sound pressure as heat while trapping the additionally reduced sound in another cavity formed between the back layer 5 and the wall, from which the opposite polarity of the sound wave gets sucked back through with reduced SPL.

Figure 2:
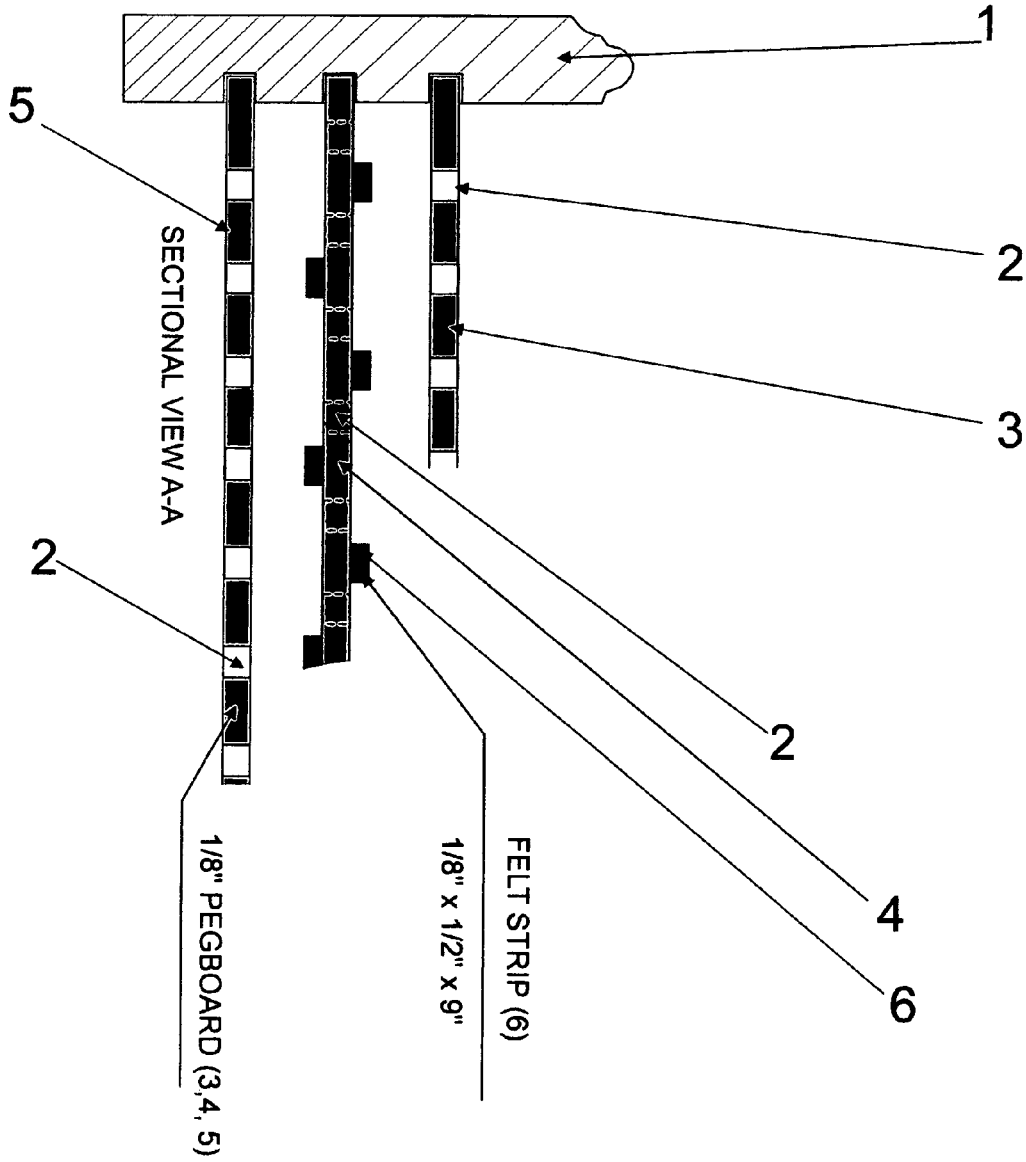
FIG. 2 shows a sectional view AA

FIG. 2 shows the addition of felt strips 6 which may be applied on the inside to one or more of the pegboard layers 3,4,5.

The panel 10 is designed and supplied with appropriate mounting hardware such that the panel 10 may be mounted to a vertical surface or wall, such that the back of the frame 1 rests flush with the wall.

Frame 1 is preferably formed from wood, but maybe any other appropriate material. Frame 1 has grooves machined along the insides into which the edges of the three layers of pegboard 3,4,5, are positioned. The grooves perform the function of holding the pegboard securely in place and providing a means for keeping the desired spacing between the three layers of pegboard. Alternative means of locating the pegboard and holding securely in place may be adopted.

The pegboard layers 3,4,5, are constructed of commercially available pegboard material. The through holes 2 are ¼" diameter holes on 1" centers. The panel 10 consists of 3 layers of ⅛" pegboard 3,4,5, with ¼" diameter holes on 1" centers. The pegboards 3,4,5, are spaced about 5/16" apart by grooves in the 1" wide by 2" deep edges of the panel frame 1 that holds the pegboard layers together. The layers 3,4,5, may be alternatively constructed of alternative material with through holes 2 to perform the action.

Figure 4:
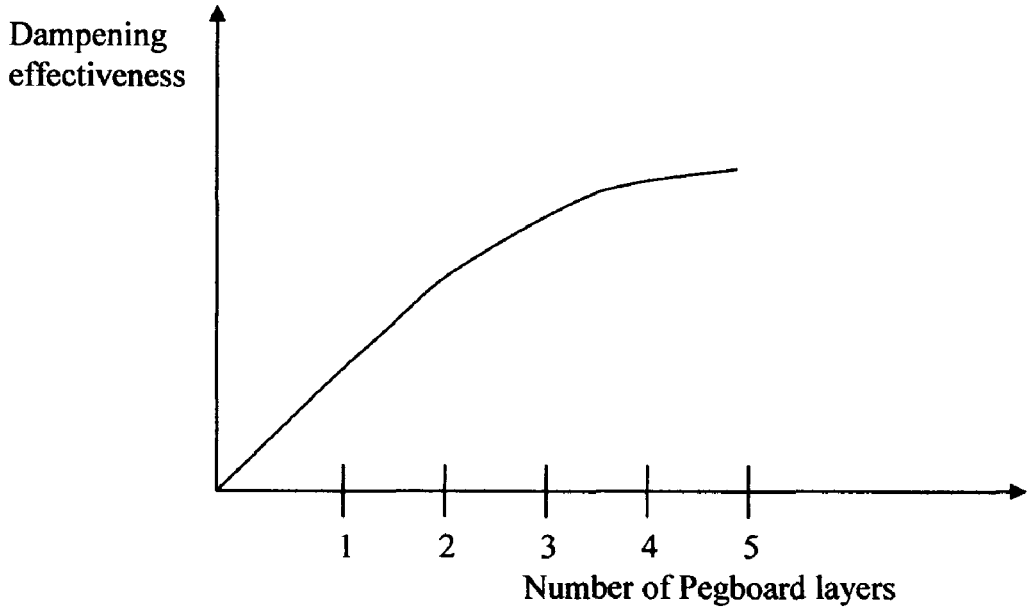

The panel 10 preferably has three layers of pegboard, which the designers have determined empirically through testing gives the optimum performance of functionality versus aesthetic appeal. The results of the testing are illustrated in FIG. 4.

Figure 5:
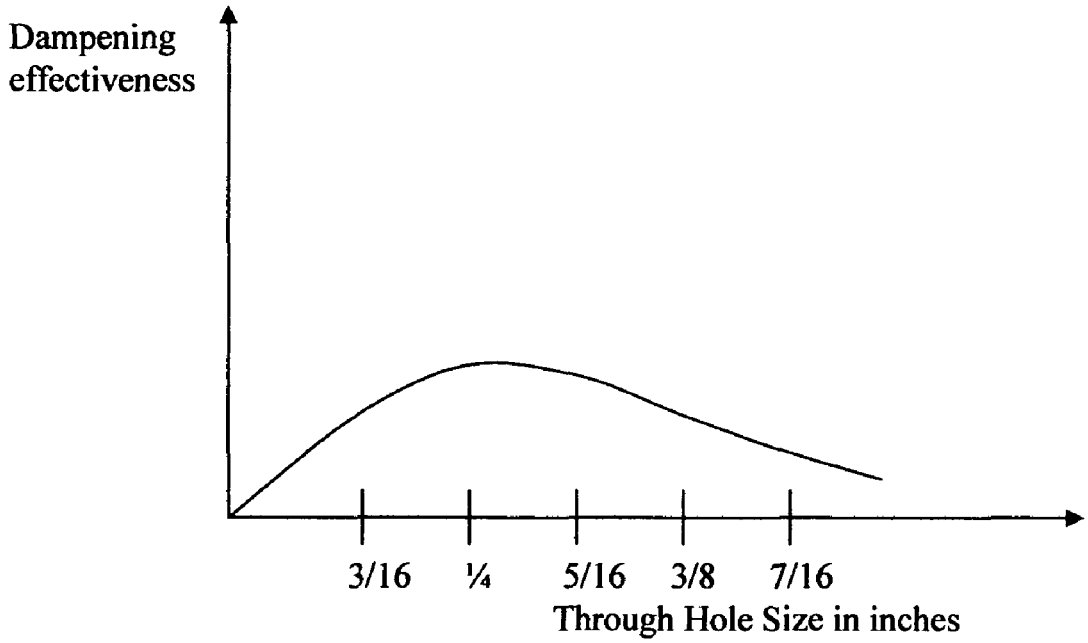

The panel 10 preferably has through holes of ¼ inch diameter, which the designers have determined empirically through testing gives the optimum performance. The results of the testing are illustrated in FIG. 5.

Figure 6:
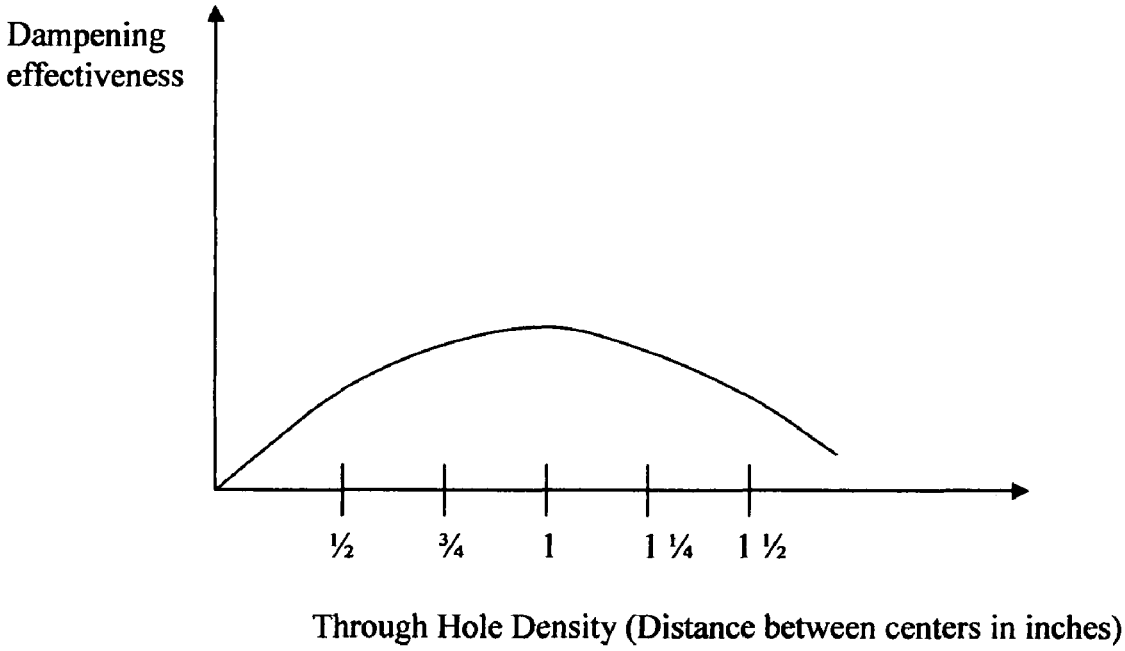

The panel 10 preferably has through holes spaced apart 1 inch between hole centers, which the designers have determined empirically through testing gives the optimum performance of functionality. The results of the testing are illustrated in FIG. 6.

Figure 7:
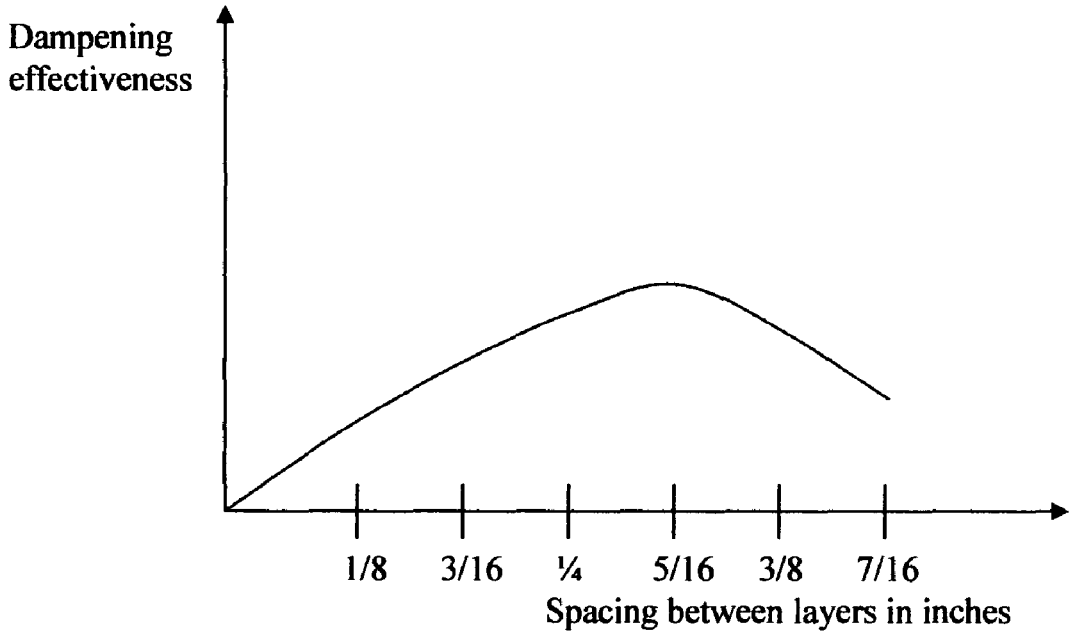

The panel 10 preferably has 5/16 inch spacing between pegboard layers, which the designers have determined empirically through testing gives the optimum performance of functionality. The results of the testing are illustrated in FIG. 7.

Figure 8:
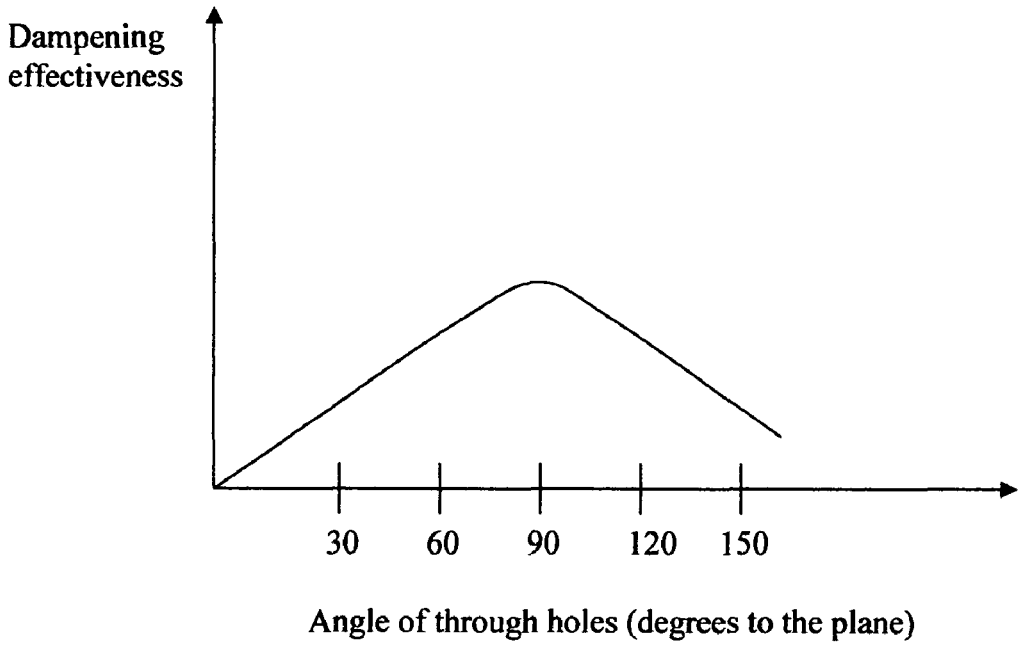

The panel 10 preferably has though holes at right angle to the plane of the pegboard, which the designers have determined empirically through testing gives the optimum performance of functionality. The results of the testing are illustrated in FIG. 8.

The panel 10 preferably may have an acoustic transparent cloth material applied over the top of the front pegboard 3 and frame 1 to enhance the aesthetic appeal of the product.

The addition of felt strips 6 may be optionally added to the construction to further dampen the airflow through the panel.

We claim:

1. A high frequency preserving, sound pressure standing wave reducing, acoustic room treatment panel, comprising the following elements;

a. An enclosure having a frame comprising top, bottom and side pieces joined at the ends of the pieces to define a frame structure, b. A first layer of flat material with multiple through holes, of the same dimension, mounted within the frame structure, c. A second layer of flat material with multiple through holes of the same dimensions as used in the first layer, mounted within the frame structure located behind, and spaced more than ¼ inch apart from the first layer of flat material and aligned so that the through holes in the second layer of flat material are off-set, to the maximum amount possible, from the through holes in the first layer of flat material, d. A third layer of flat material with multiple through holes, of the same dimensions as used in the first layer and second layer, mounted within the frame structure located behind, and spaced more than ¼ inch apart from the second layer of flat material and aligned so that the through holes in the third layer of flat material are off-set, to the maximum amount possible, from the through holes in the second layer of flat material, such that the through holes in the third layer become re-aligned with the through holes in the first layer.

2. A high frequency preserving, sound pressure standing wave reducing, acoustic room treatment panel, of claim 1, wherein the through holes are dimensioned with a nominal diameter of ¼ inch, spaced apart at substantially 1 inch between centers.

3. A high frequency preserving, sound pressure standing wave reducing, acoustic room treatment panel, of claim 1, wherein the three layers of flat material with multiple through holes are spaced apart a nominal 5/16 inch.

4. A high frequency preserving, sound pressure standing wave reducing, acoustic room treatment panel, of claim 1, wherein more than 3 layers of flat material with through holes are incorporated into the frame structure.

5. A high frequency preserving, sound pressure standing wave reducing, acoustic room treatment panel, of claim 1, wherein two or more of the elements are combined to form composite structures.

6. A high frequency preserving, sound pressure standing wave reducing, acoustic room treatment panel, of claim 1, wherein the frame structure is a shape other than rectangle.

7. A high frequency preserving, sound pressure standing wave reducing, acoustic room treatment structure, comprising a. An enclosure having two or more acoustic room treatment panels, each acoustic room treatment panel comprising the following elements;

b. frame, comprising top, bottom and side pieces joined at the ends of the pieces to define a frame structure, with the frame structure being joined together, c. A first layer of flat material with multiple through holes, of the same dimension, mounted within each frame structure, d. A second layer of flat material with multiple through holes of the same dimensions as used in the first layer, mounted within the frame structure located behind, and spaced more than ¼ inch apart from the first layer of flat material and aligned so that the through holes in the second layer of flat material are off-set, to the maximum amount possible, from the through holes in the first layer of flat material, e. A third layer of flat material with multiple through holes, of the same dimensions as used in the first layer and second layer, mounted within the frame structure located behind, and spaced more than ¼ inch apart from the second layer of flat material and aligned so that the through holes in the third layer of flat material are off-set, to the maximum amount possible, from the through holes in the second layer of flat material, such that the through holes in the third layer become re-aligned with the through holes in the first layer.

8. A high frequency preserving, sound pressure standing wave reducing, acoustic room treatment structure, of claim 7, wherein the through holes are dimensioned with a nominal diameter of ¼ inch, spaced apart at substantially 1 inch between centers.

9. A high frequency preserving, sound pressure standing wave reducing, acoustic room treatment structure, of claim 7, wherein the three layers of flat material with multiple through holes are spaced apart a nominal 5/16 inch.

10. A high frequency preserving, sound pressure standing wave reducing, acoustic room treatment structure, of claim 7, wherein more than 3 layers of flat material with through holes are incorporated into the frame structures.

11. A high frequency preserving, sound pressure standing wave reducing, acoustic room treatment structure, of claim 7, wherein two or more of the elements are combined to form composite structures.

12. A high frequency preserving, sound pressure standing wave reducing, acoustic room treatment structure, of claim 7, wherein one or more of the frame structures is a shape other than rectangle.

13. A high frequency preserving, sound pressure standing wave reducing, acoustic room treatment panel, comprising the following elements;

a. An enclosure having a frame comprising top, bottom and side pieces joined at the ends of the pieces to define a frame structure, b. A first layer of curved material with multiple through holes, of the same dimension, mounted within the frame structure, c. A second layer of curved material with multiple through holes of the same dimensions as used in the first layer, mounted within the frame structure located behind, and spaced more than ¼ inch apart from the first layer of curved material and aligned so that the through holes in the second layer of curved material are off-set, to the maximum amount possible, from the through holes in the first layer of curved material, d. A third layer of curved material with multiple through holes, of the same dimensions as used in the first layer and second layer, mounted within the frame structure located behind, and spaced more than ¼ inch apart from the second layer of curved material and aligned so that the through holes in the third layer of curved material are off-set, to the maximum amount possible, from the through holes in the second layer of curved material, such that the through holes in the third layer become re-aligned with the through holes in the first layer.

14. A high frequency preserving, sound pressure standing wave reducing, acoustic room treatment panel, of claim 13, wherein the through holes are dimensioned with a nominal diameter of ¼ inch, spaced apart at substantially 1 inch between centers.

15. A high frequency preserving, sound pressure standing wave reducing, acoustic room treatment panel, of claim 13, wherein the three layers of curved material with multiple through holes are spaced apart a nominal 5/16 inch.

16. A high frequency preserving, sound pressure standing wave reducing, acoustic room treatment panel, of claim 13, wherein more than 3 layers of curved material with through holes are incorporated into the frame structure.

17. A high frequency preserving, sound pressure standing wave reducing, acoustic room treatment panel, of claim 13, wherein two or more of the elements are combined to form composite structures.

18. A high frequency preserving, sound pressure standing wave reducing, acoustic room treatment panel, of claim 13, wherein the frame structure is a shape other than rectangle.

* * * * *